US009455504B2

(12) United States Patent
Kim et al.

(10) Patent No.: US 9,455,504 B2
(45) Date of Patent: Sep. 27, 2016

(54) WIRE TERMINAL CONNECTOR WITH IMPROVED CLAMPING FORCE

(71) Applicants: Hyundai Motor Company, Seoul (KR); Kia Motors Corporation, Seoul (KR); Yura Corporation Co., Ltd., Cheongju, Ghungcheongbuk-Do (KR)

(72) Inventors: Sung Ii Kim, Gyeonggi-Do (KR); Yun Seok Kang, Seoul (KR); Chi Bong Ha, Seoul (KR); Moon Sik Kang, Gyeonggi-Do (KR)

(73) Assignees: Hyundai Motor Company, Seoul (KR); Kia Motors Corporation, Seoul (KR); Yura Corporation Co., Ltd., Cheongju, Chungcheongbuk-do (KR)

( * ) Notice: Subject to any disclaimer, the term of this patent is extended or adjusted under 35 U.S.C. 154(b) by 0 days.

(21) Appl. No.: 14/732,737

(22) Filed: Jun. 7, 2015

(65) Prior Publication Data

US 2016/0134029 A1 May 12, 2016

(30) Foreign Application Priority Data

Nov. 7, 2014 (KR) ..... 10-2014-0154692

(51) Int. Cl.
*H01R 4/10* (2006.01)
*H01R 4/28* (2006.01)

(52) U.S. Cl.
CPC ..... *H01R 4/28* (2013.01)

(58) Field of Classification Search
CPC .... H01R 4/185; H01R 4/188; H01R 4/2495; H01R 4/203; H01R 43/048
USPC ..... 439/877, 442, 882, 421
See application file for complete search history.

(56) References Cited

U.S. PATENT DOCUMENTS

| | | | | |
|---|---|---|---|---|
| 3,892,459 | A * | 7/1975 | Dittmann | H01R 4/188 174/84 C |
| 7,210,958 | B1 * | 5/2007 | Jacques | H01R 4/185 439/421 |
| 8,177,591 | B2 * | 5/2012 | Okamura | H01R 4/188 439/877 |
| 8,246,394 | B2 * | 8/2012 | Ono | H01R 4/185 439/877 |
| 8,303,355 | B2 * | 11/2012 | Ono | H01R 4/185 439/877 |
| 8,337,262 | B2 * | 12/2012 | Ono | H01R 4/185 439/877 |
| 8,485,853 | B2 * | 7/2013 | Seifert | H01R 4/188 439/882 |
| 9,099,794 | B2 * | 8/2015 | Ito | H01R 4/188 |
| 2011/0009014 | A1 * | 1/2011 | Ono | H01R 4/185 439/877 |
| 2011/0124247 | A1 | 5/2011 | Okamura et al. | |
| 2012/0028494 | A1 | 2/2012 | Ono et al. | |
| 2013/0062117 | A1 | 3/2013 | Ono et al. | |
| 2013/0062118 | A1 | 3/2013 | Ono et al. | |
| 2014/0004758 | A1 | 1/2014 | Kondou et al. | |

FOREIGN PATENT DOCUMENTS

| | | | |
|---|---|---|---|
| JP | 2009-176673 | A | 8/2009 |
| JP | 2009-231112 | A | 10/2009 |
| JP | 2010-010000 | A | 1/2010 |
| JP | 2010-010001 | A | 1/2010 |
| JP | 2010-027463 | A | 2/2010 |
| JP | 2010-244883 | A | 10/2010 |
| KR | 2012-0010265 | | 2/2012 |
| KR | 10-1254310 | | 4/2013 |
| KR | 10-1254311 | | 4/2013 |
| KR | 2013-0049306 | | 5/2013 |
| KR | 2013-0070409 | | 6/2013 |
| KR | 2013-0137677 | | 12/2013 |

* cited by examiner

*Primary Examiner* — Hae Moon Hyeon
(74) *Attorney, Agent, or Firm* — Mintz Levin Cohn Ferris Glovsky and Popeo, P.C.; Peter F. Corless

(57) ABSTRACT

A wire terminal connector is provided that includes a clamping portion that encircles a conductor exposed at an end of an electric wire in a clamping manner. The clamping portion also has a plurality of recesses that are formed on a portion thereof in contact with the conductor. In addition, the wire terminal connector includes a grip portion that encircles a sheath of the electric wire.

8 Claims, 4 Drawing Sheets

WIRE TERMINAL CONNECTOR WITH IMPROVED CLAMPING FORCE

CROSS-REFERENCE TO RELATED APPLICATION

This application is based on and claims the benefit of priority to Korean Patent Application No. 10-2014-0154692, filed on Nov. 7, 2014 in the Korean Intellectual Property Office, the disclosure of which is incorporated herein in its entirety by reference.

TECHNICAL FIELD

The present disclosure relates to a wire terminal connector, and more particularly, to a wire terminal connector that has increased binding power and connection strength with respect to an electric wire.

BACKGROUND

The present invention improves wire terminal connectors of the related art by improving the clamping force of a terminal for clamping an aluminum wire and reducing a weight of a vehicle by improving connection strength between an aluminum wire and a terminal. Technical subjects of the present disclosure are not limited to the foregoing technical subjects and any other technical subjects not mentioned will be clearly understood by a skilled person in the art from the following description.

SUMMARY

The present disclosure provides a wire terminal connector that has improved clamping force of a terminal for clamping an aluminum wire and has reduced weight of a vehicle by improving connection strength between an aluminum wire and a terminal.

Technical subjects of the present disclosure are not limited to the foregoing technical subjects and any other technical subjects not mentioned will be clearly understood by a skilled person in the art from the following description.

According to an exemplary embodiment of the present disclosure, a wire terminal connector may include: a clamping portion that encircles a conductor exposed in an end of an electric wire in a clamping manner and has a plurality of recesses formed on a portion thereof in contact with the conductor; and a grip portion that encircles a sheath of the electric wire. Specific matters of other exemplary embodiments are included in the detailed description and drawings.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
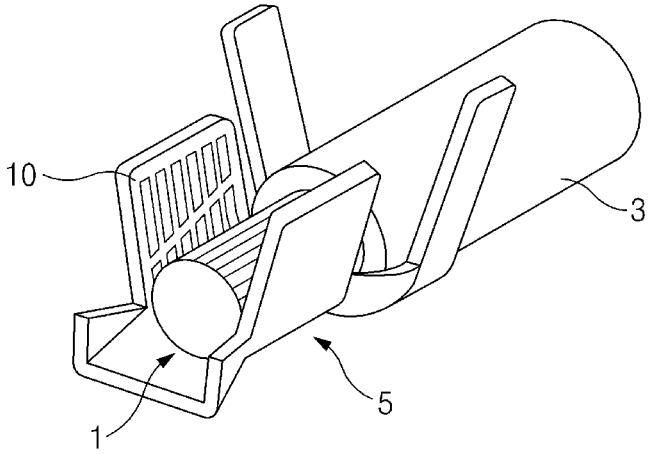
FIG. 1 is an exemplary view of a wire terminal connector according to an exemplary embodiment of the present disclosure before fixing an electric wire.

The terminology used herein is for the purpose of describing particular embodiments only and is not intended to be limiting of the invention. As used herein, the singular forms "a", "an" and the are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about"

Advantages and features of the present disclosure, and implementation methods thereof will be clarified through following exemplary embodiments described with reference to the accompanying drawings. The present disclosure may, however, be embodied in different forms and should not be construed as limited to the embodiments set forth herein. Rather, these exemplary embodiments are provided so that this disclosure will be thorough and complete, and will fully convey the scope of the present disclosure to those skilled in the art. Further, the present disclosure is only defined by scopes of claims. Like reference numerals refer to like elements throughout.

Figure 2:
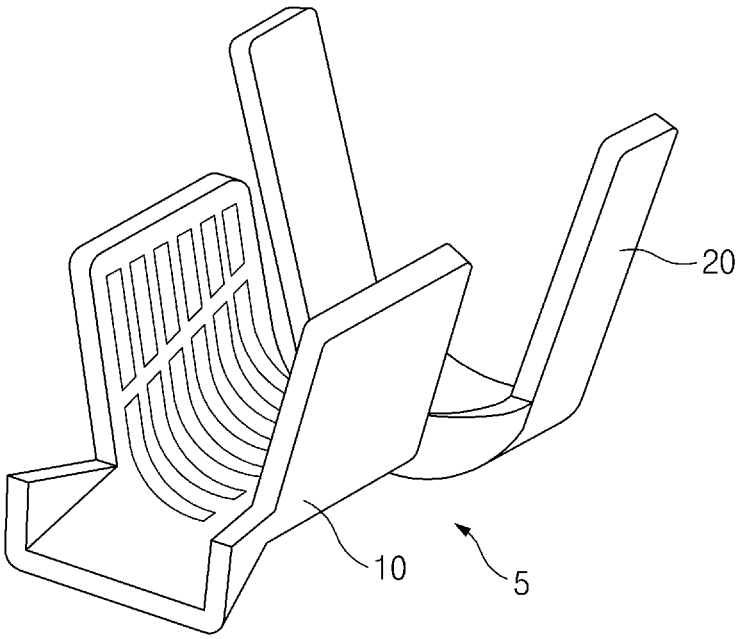
FIG. 2 is an exemplary view of the wire terminal connector according to an exemplary embodiment of the present disclosure.

Hereinafter, a wire terminal connector 5 according to exemplary embodiments of the present disclosure will be described with reference to the accompanying drawings. FIG. 1 is an exemplary view of a wire terminal connector 5 according to an exemplary embodiment of the present disclosure before fixing an electric wire. FIG. 2 is an exemplary view of the wire terminal connector 5 according to an exemplary embodiment of the present disclosure.

Referring to FIGS. 1 and 2, the wire terminal connector 5 according to an exemplary embodiment of the present disclosure may include a clamping portion 10 that encircles a conductor 1 exposed at an end of an electric wire in a clamping manner and has a plurality of recesses formed on a portion thereof in contact with the conductor 1; and a grip portion 20 that encircles a sheath 3 of the electric wire. The sheath 3 may be formed of a material that has elasticity, and thus, may be deformed as the grip portion 20 is deformed. Accordingly, the grip portion 20 may fix the sheath 3.

Figure 3A:
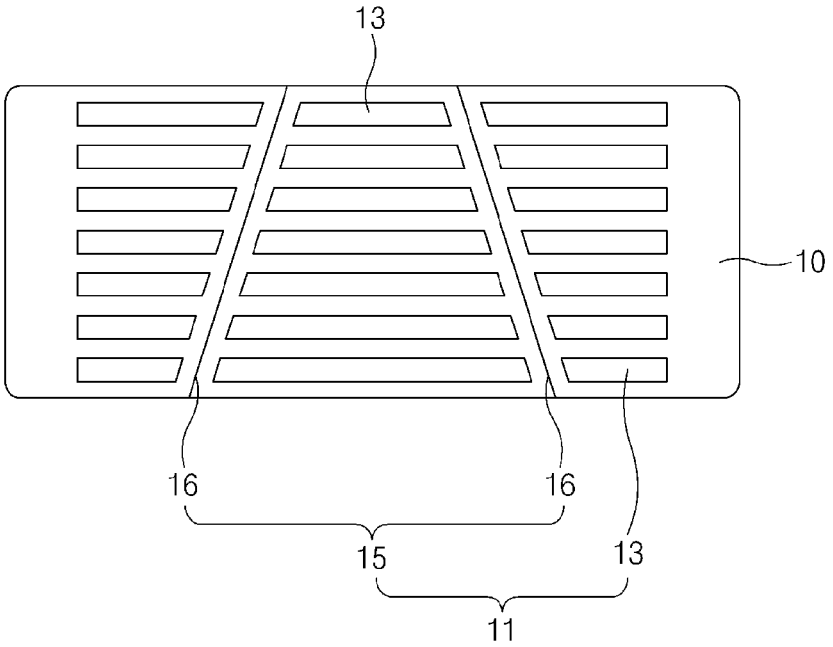
FIGS. 3*a* and 3*b* are exemplary views of a clamping portion according to an exemplary embodiment of the present disclosure.
Figure 3B:
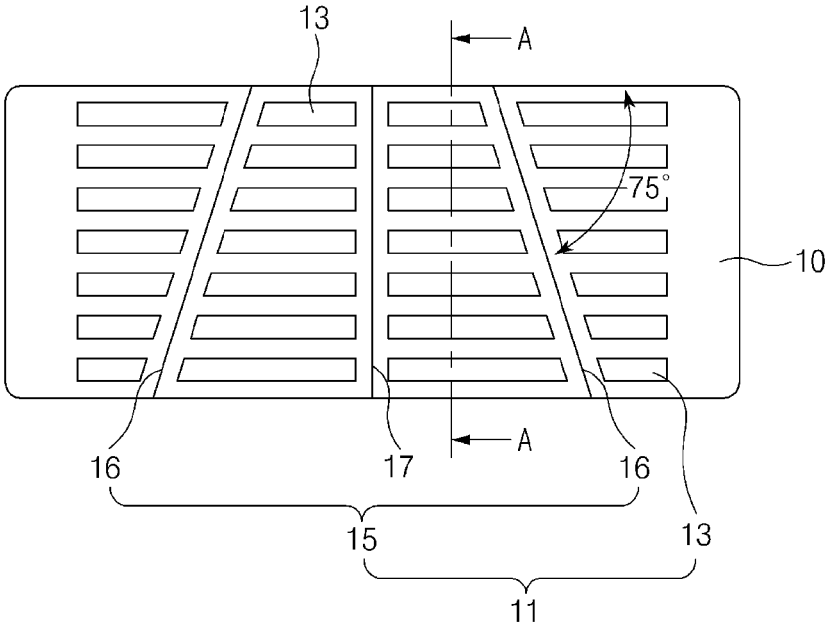

FIGS. 3*a* and 3*b* are exemplary views of the clamping portion 10 according to an exemplary embodiment of the present disclosure. Retelling to FIG. 3*a*, a plurality of recesses 11 may include vertical recesses 13 formed to extend in a direction perpendicular to a direction in which the electric wire extends. The plurality of recesses 11 may include intersecting recesses 15 formed to intersect the vertical recesses 13. Additionally, the intersecting recesses 15 may include first intersecting recesses 16 that intersect the vertical recesses 13 at about 75 degrees.

As illustrated in FIG. 3*b*, the intersecting recesses 15 may include a second intersecting recess 17 that intersects the vertical recesses 13 at about 90 degrees. With the second intersecting recess 17, grip power for fixing an electric wire may increase, compared to when the second intersecting recess 17 is not formed. The first intersecting recesses 16 may be formed on left and right sides with the second intersecting recess 17 interposed therebetween. The first intersecting recesses 16 and the vertical recesses 13 may be connected to form one side of a trapezoid shape.

Figure 4:
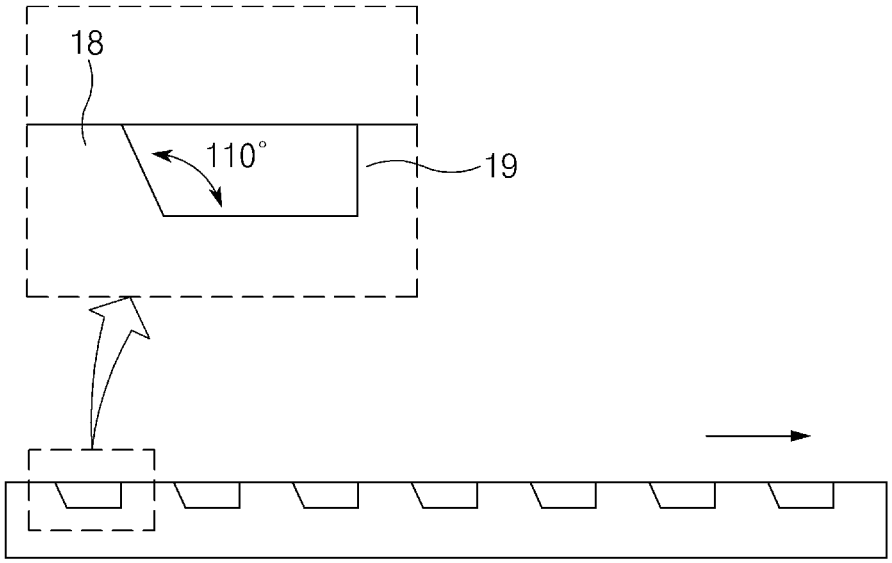
FIG. 4 is an exemplary cross-sectional view of the clamping portion taken along line A-A of FIG. 3*b* and a detailed view thereof according to an exemplary embodiment of the present disclosure.

FIG. 4 includes an exemplary cross-sectional view of the clamping portion taken along line A-A of FIG. 3*b* and an exemplary detailed view thereof. Referring to FIG. 4, the clamping portion 10 may include an outer side wall portion 18 that forms each vertical recess 13 and may be provided as a side wall in a direction of the end portion of the conductor 1; and an inner side wall portion 19 that forms each vertical recess 13, facing the outer side wall portion 18, and provided as a side wall in a direction of the sheath 3, wherein the outer side wall portion 18 may be formed to be sloped.

In particular, the outer side wall portion 18 may be sloped toward the end portion of the conductor 1 at a tilt angle of about 110 degrees. The inner side wall portion 19 may be formed at about 90 degrees. Since the first intersecting recesses 16, among the plurality of recesses 11, may be formed at about 75 degrees, the electric wire may be more effectively encircled during clamping and a fixing force of the conductor 1 may increase. Additionally, since clamping force of the electric wire increases, electrical connectivity may be improved.

Furthermore, the outer side wall portion 18 may tilt at about 110 degrees. When the clamping portion 10 is compressed to the conductor 1 of the electric wire, the conductor 1 may be pressed by the clamping portion 10 to be plastic-deformed in the direction in which the conductor 1 extends. In particular, an oxide layer formed on a surface of the conductor 1 comes into contact (e.g., may be formed adjacent to or in contact with) with the outer side wall portion 18 formed in the clamping portion 10 and may be delaminated from the conductor 1. The surface of the conductor 1 may be exposed to come into contact with the clamping portion 10. Thus, contact resistance between the conductor 1 and the terminal connector may be reduced. In other words, the wire terminal connector 5 may damage the oxide film generated on the conductor 1 of the aluminum wire to a maximum level, thus reducing resistance and increasing electrical connectivity.

According to the present disclosure, the following advantages may be obtained. First, clamping force of the terminal for clamping an aluminum wire may be improved. Second, a weight of a vehicle may be reduced by enhancing connection strength between an aluminum wire and the terminal.

The advantages and effects of the present disclosure are not limited to the aforesaid, and any other advantages and effects not described herein will be clearly understood by those skilled in the art from descriptions of claims.

The present disclosure described above may be variously substituted, altered, and modified by those skilled in the art to which the present disclosure pertains without departing from the scope and spirit of the present disclosure. Therefore, the present disclosure is not limited to the above-mentioned exemplary embodiments and the accompanying drawings.

What is claimed is:

1. A wire terminal connector, comprising:

a clamping portion that encircles a conductor exposed at an end of an electric wire in a clamping manner and includes a plurality of recesses formed on a portion thereof in contact with the conductor; and a grip portion that encircles a sheath of the electric wire, wherein the plurality of recesses include vertical recesses formed to extend in a direction perpendicular to a direction in which the electric wire extends, and intersecting recesses formed to intersect the vertical recesses.

2. The wire terminal connector according to claim 1, wherein the intersecting recesses include first intersecting recesses that intersect the vertical recesses at about 75 degrees.

3. The wire terminal connector according to claim 2, wherein the intersecting recesses include a second intersecting recess that intersect the vertical recesses at about 90 degrees.

4. The wire terminal connector according to claim 3, wherein the first intersecting recesses are formed on left and right sides with the second intersecting recess interposed therebetween.

5. The wire terminal connector according to claim 4, wherein the first intersecting recesses and the vertical recesses are connected to form one side of a trapezoid shape.

6. The wire terminal connector according to claim 2, wherein the clamping portion includes:

an outer side wall portion that forms each vertical recess and is provided as a side wall in a direction of an end portion of the conductor; and an inner side wall portion that forms each vertical recess, facing the outer side wall portion, and is provided as a side wall in a direction of the sheath, wherein the outer side wall portion is formed to be sloped.

7. The wire terminal connector according to claim 6, wherein the outer side wall portion is sloped toward the end portion of the conductor at a tilt angle of about 110 degrees.

8. The wire terminal connector according to claim 7, wherein the inner side wall portion is formed at about 90 degrees.

* * * * *